US009920500B2

(12) United States Patent
Thompson et al.

(10) Patent No.: US 9,920,500 B2
(45) Date of Patent: Mar. 20, 2018

(54) APPARATUS AND METHOD FOR MAT INSTALLATION

(71) Applicant: SEABED SERVICES LLC, Houston, TX (US)

(72) Inventors: Wayne Leslie Thompson, Navasota, TX (US); Harry Charles Tate, Richwood, TX (US)

(73) Assignee: SEABED TECHNOLOGIES LLC, Houston, TX (US)

( * ) Notice: Subject to any disclaimer, the term of this patent is extended or adjusted under 35 U.S.C. 154(b) by 516 days.

(21) Appl. No.: 13/660,121

(22) Filed: Oct. 25, 2012

(65) Prior Publication Data

US 2014/0119836 A1 May 1, 2014

(51) Int. Cl.
*E02D 29/00* (2006.01)
*E02D 17/20* (2006.01)

(52) U.S. Cl.
CPC ..... *E02D 17/202* (2013.01)

(58) Field of Classification Search
USPC ..... 405/15, 17, 19, 171, 172, 173, 184.4; 294/74
See application file for complete search history.

(56) References Cited

U.S. PATENT DOCUMENTS

| | | | | |
|---|---|---|---|---|
| 3,425,228 | A | 2/1969 | Lamberton | |
| 3,837,169 | A | 9/1974 | Lamberton | |
| 4,201,494 | A * | 5/1980 | Crowe | 405/17 |
| 4,486,120 | A | 12/1984 | Landry, Jr. | |
| 5,722,795 | A | 3/1998 | Angel et al. | |
| 5,944,449 | A | 8/1999 | Angel et al. | |
| 6,027,285 | A | 2/2000 | Angel et al. | |
| 6,106,194 | A | 8/2000 | Angel et al. | |
| 6,139,220 | A | 10/2000 | Angel et al. | |
| 6,406,217 | B1 | 6/2002 | Daniel et al. | |
| 6,416,253 | B1 | 7/2002 | Wimp et al. | |
| 7,329,069 | B2 * | 2/2008 | Slater et al. | 405/114 |
| 7,329,336 | B2 | 2/2008 | Britton | |
| D580,561 | S | 11/2008 | Salerno | |
| 7,862,256 | B2 * | 1/2011 | Sprague et al. | 405/184.4 |
| 8,950,974 | B2 * | 2/2015 | Thompson | F16L 1/24 405/18 |
| 2005/0180820 | A1 * | 8/2005 | Zandwijk | 405/184.4 |
| 2010/0104379 | A1 | 4/2010 | Amuchastegui et al. | |

FOREIGN PATENT DOCUMENTS

| | | | |
|---|---|---|---|
| EP | 0001161 | A1 | 3/1979 |
| WO | WO8805842 | | 8/1988 |
| WO | WO2011144902 | A2 | 11/2011 |

OTHER PUBLICATIONS

Armorform, "Your Solution to Permanent Hard Armor Erosion Control," Armorform Incorporated, 2002 Brochure—8 sheets.

* cited by examiner

*Primary Examiner* — Thomas B Will
*Assistant Examiner* — Katherine J Chu
(74) *Attorney, Agent, or Firm* — Cantor Colburn LLP

(57) ABSTRACT

In one aspect, an apparatus for placement of a mat underwater is provided that includes a frame configured to be attached to a lifting mechanism and a connector mechanism disposed on the frame configured to couple to a first side of the mat and support the mat when coupled to and lifted by the first side. The apparatus also includes a release mechanism coupled to the connector mechanism and configured to release the mat from the connector mechanism upon receiving an input.

8 Claims, 5 Drawing Sheets

APPARATUS AND METHOD FOR MAT INSTALLATION

BACKGROUND OF THE DISCLOSURE

1. Field of the Disclosure

The disclosure relates generally to apparatus and methods for installing a mat in a body of water.

2. Description of the Related Art

Mats may be used for marine applications where separation, stabilization, protection and scour prevention is needed for pipelines and other sea floor installations are submerged in water. The mats provide resistance to hydrodynamic forces caused by currents along a sea floor, where the forces can move and/or damage the installed objects. In an example, a pipeline disposed on the sea floor is covered with a mat to stabilize the pipeline beneath the weight of the mat to resist sea floor currents.

In some cases, the size of the mats is limited due to weight and difficulty moving mats prior to installation on a sea floor. For example, concrete mats may be poured and cured in molds at a manufacturing site, removed from the molds and shipped to a dockside location where a vessel having a crane transports the mats to an installation site. Transportation of the mats from the manufacturing site to the dockside location can be costly due to the weight and size of the mats. The size and weight of the mats may also be limited by moving and lifting mechanisms capability to maneuver these objects.

In addition, a frame used for installation may be coupled two edges of the mat to properly support the load of the mat. The frame may be a significant load itself, thus reducing the size of mats lowered to the sea floor in each trip, thus causing more trips from the surface to the floor. Accordingly, the total installation time for a mat assembly at a location may be increased due to multiple trips caused by the load of lowering the frame itself.

SUMMARY

In one aspect, an apparatus for placement of a mat underwater is provided that includes a frame configured to be attached to a lifting mechanism and a connector mechanism disposed on the frame configured to couple to a first side of the mat and support the mat when coupled to and lifted by the first side. The apparatus also includes a release mechanism coupled to the connector mechanism and configured to release the mat from the connector mechanism upon receiving an input.

In another aspect, a method of placing a mat includes providing a mat including a plurality of fabric cells formed from a first fabric layer and a second fabric layer, wherein ports in each of the fabric cells provide fluid communication between each of the fabric cells and pumping the plurality of fabric cells with a filling material at a loading site. The method also includes coupling a connector mechanism on a frame to a first side of the filled mat, lifting the filled mat by a lifting mechanism coupled to the frame, wherein the frame and connector mechanism support the filled mat when lifted by the first side and lowering the filled concrete mat into a body of water via the lifting mechanism.

BRIEF DESCRIPTION OF THE DRAWINGS

The disclosure herein is best understood with reference to the accompanying figures in which like numerals have generally been assigned to like elements and in which.

DETAILED DESCRIPTION

Figure 1:
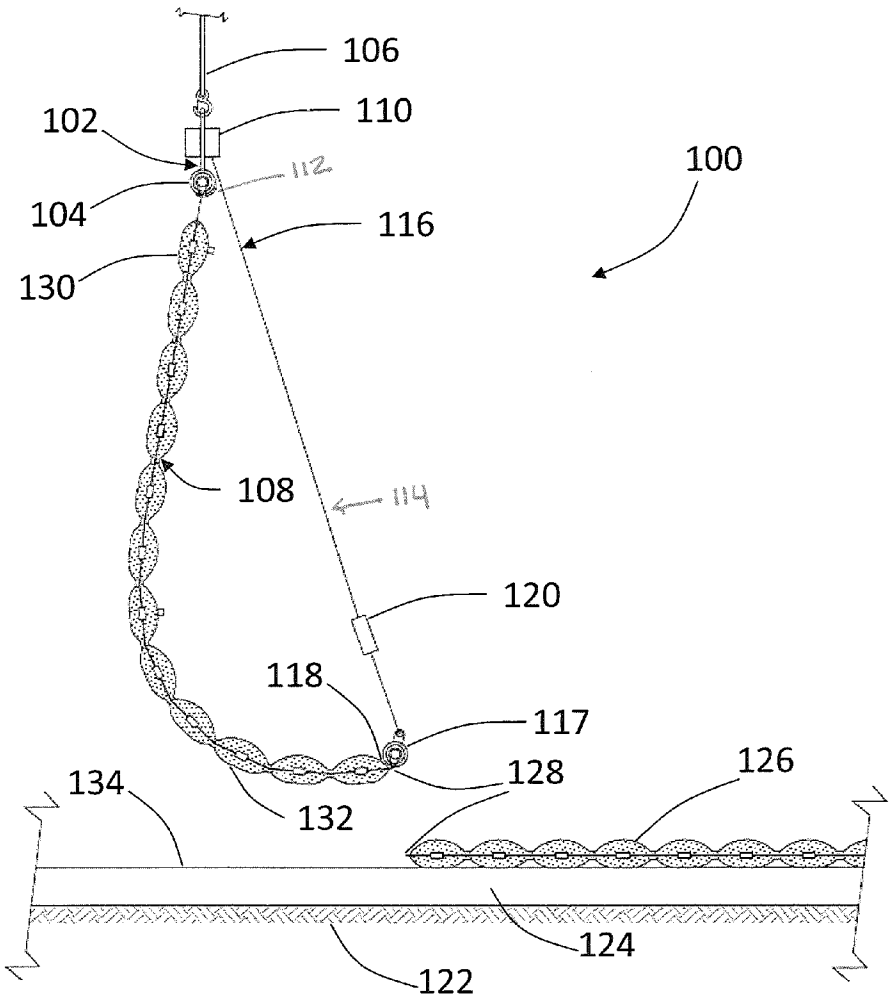
FIG. 1 is a side view of an exemplary mat disposed on a sea floor to secure a pipeline according to an embodiment.

FIG. 1 is a side view of a portion of an exemplary apparatus 100 for placement of a mat 108 underwater, such as on a pipeline 124 disposed on a sea floor 122. The apparatus 100 includes a frame 102 with a bar 104 coupled to the mat 108. In an embodiment, the mat 108 is releasably coupled to the bar 104 and frame 102 by a connector mechanism 112. The frame 102 and connector mechanism 112 are configured to be attached to a lifting mechanism 106, such as a cable or straps extending from a crane or boom. In an embodiment, the lifting mechanism 106 moves the mat 108 after it is filled with a filling material, where the filled mat 108 can be a substantial load for the lifting mechanism. The lifting mechanism 106 may be used to move the mat 108 from a first location to a second location. For example, the lifting mechanism 106 may move the mat from a vessel to an installation site, such as an underwater pipeline positioned on a sea bed. In embodiments, the connector mechanism 112 and frame 102 are configured to support the mat 108 when coupled to a first side 130 of the mat 108. In one embodiment, the mat 108 is entirely supported by the connector mechanism 112 connected to the first side 130 of the mat 108. As described in detail below, the mat 108 includes a grid (e.g., cable grid) integrated in the mat structure to couple to the connector mechanism 112, thus supporting the entire mat when lifted by the frame 102 coupled to the first side 130.

In one embodiment, the apparatus 100 includes a support assembly 114 coupled to a second side 132 of the mat 108, where the first side 132 is opposite and substantially parallel to the second side 130 of the mat. The support assembly 114 includes a suspender 116, a bar 117, a second connector mechanism 118 and a release mechanism 120. In an embodiment, the support assembly 114 provides improved control of the mat 108 during movement and placement on the pipeline 124 or sea floor 122. Other embodiments do not include the support assembly 114 and, therefore, provide support and control movement of the mat 108 when the frame 102 and connector mechanism 112 are only coupled to the first side 130. When the mat 108 is positioned at an installation site 134, the connector mechanism 112 may be released from the mat 108 by release mechanism 110. In an embodiment, the release mechanism 110 is operationally coupled to the connector mechanism 112. In an embodiment, the release mechanism 110 is configured to release the first side 130 of the mat 108 based on an input, such as a wireless or acoustic signal. In an embodiment with the optional support assembly 114, the release mechanism 120 is configured to release the second side 132 of the mat 108 based on a received input, such as a wireless or acoustic signal. The apparatus 100 provides improved control during mat installation, thus enabling the mat 108 to be placed adjacent to an installed mat 126. In an embodiment, the mats 108 and 126 each include end connectors 128 to enable chaining of the mats. Accordingly, large mat installations are enabled by the installation apparatus 100 and mats 108, 126. In an embodiment, the mat 108 is formed by connecting a first mat section and a second mat section via a connector mechanism. In addition, the arrangement of the apparatus enables a large mat to be installed on a sea floor in a single trip, thus reducing overall mat installation time.

In embodiments, once installed, the mat 108 is positioned over a pipeline 124 and is configured to secure or prevent movement of the pipeline 124 along the sea floor due to currents and other hydrodynamic forces. In an embodiment, the mat 100 is disposed over a pipeline or an intersection of pipelines to prevent movement of the pipelines due to current forces.

As depicted, the substantially vertical orientation (also referred to as "J orientation") of the mat 108, including versions with and without the support assembly 114, provides reduced loading on the lifting mechanism 106 during installation. Specifically, as the mat 108 is lowered to the sea floor, a vessel with using the lifting mechanism 106, such as a crane or winch, will experience reduced loading as the vessel moves due to surface currents. The substantially vertical orientation of the mat 108 reduces the resistance or drag in the vertical direction that may be induced due to vertical vessel movement. For example, as compared to mat installation arrangements with connections to two or more sides that cause a horizontal sail-shaped orientation or U-shaped orientation for the mat, the substantially vertical orientation provides less loading on the lifting mechanism 106. In embodiments with the U-shaped orientation, connections from an installation frame to opposite and parallel mat edges that are at a substantially identical vertical elevation, thus causing the center portion of the mat to contact the sea floor first. Accordingly, in a vessel used for installation of mats using a frame with a U-shaped orientation of the mats, vessel movement can lead to excessive loading for the lifting mechanism as compared to the substantially vertical or J-shaped orientation depicted in FIG. 1.

Figure 2:
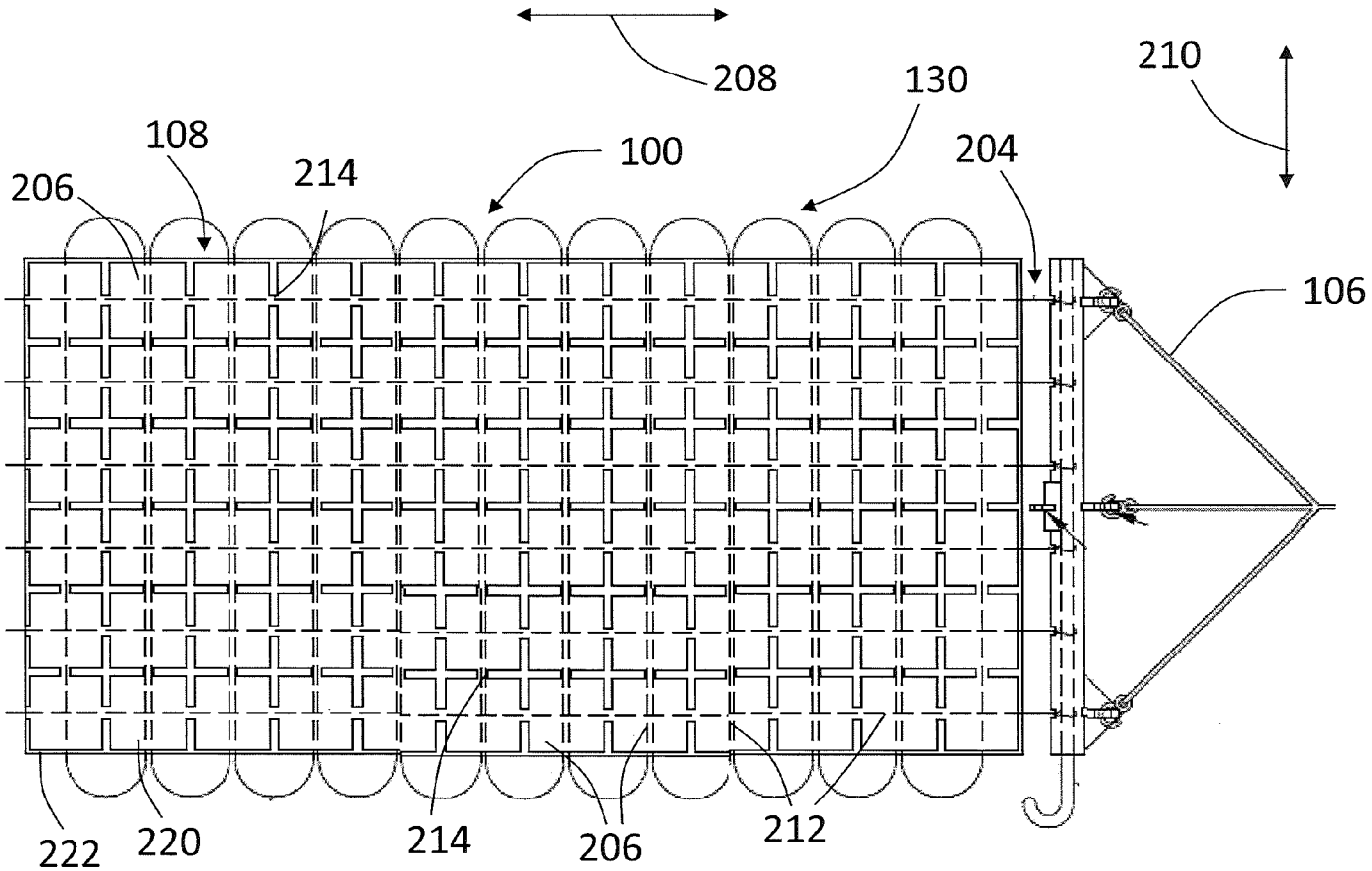
FIG. 2 is a front view of an exemplary mat with one side of the mat coupled to a frame and a lifting mechanism according to an embodiment.

FIG. 2 is a front view of an exemplary mat 100 coupled to a portion of a lifting mechanism 106 according to an embodiment. The mat 100 is coupled to the lifting mechanism 106 at a first side 130 of the mat 100 where connectors 204 completely support the mat 100. The lifting mechanism 106 may include a crane used to move the mat 100 after fabric cells 206 in the mat 100 are filled with a filling material and cured. As depicted, the fabric cells 206 are substantially symmetrically arranged in a first direction 208 and a second direction 210, where the first and second directions are substantially perpendicular. The symmetrical arrangement provides substantially similar mat 100 articulation in the first and second directions 208 and 210. In an embodiment, the pattern of the fabric cells 206 is substantially the same in the first direction 208 and the second direction 210 due to the substantially square cell shape and checked cell arrangement. A cable grid 212 is shown embedded in the mat 100 between two fabric layers, where the connectors 204 are extend from the cable grid 212 to completely support the finished mat 100 from one side (e.g., first side 130) of the mat during movement and installation.

A detailed description of embodiments of the mat 100 is now provided. According to an embodiment, the mat 100 includes a plurality of substantially symmetrically aligned fabric cells 206. The cells 206 are formed from a first fabric layer 220 and a second fabric layer 222, where the layers are joined together by a suitable coupling method, such as stitching or adhesives. In an embodiment, the fabric layers are woven from non-abrasive fabric, such as nylon, nylon/polyester blends, Kevlar™ cotton blends or wool. In one embodiment, the cable grid 212 is embedded in and disposed within the fabric cells 206, respectively, and thus support the mat 100 when the fabric cells are filled with a filling material, such as concrete. As depicted, the cable grid 212 is disposed in between the fabric layers where cables making up the grid are located in ports 214. In addition, the ports 214 are configured provide fluid communication between adjacent fabric cells. In an embodiment, ports 214 may be positioned substantially at the center of each edge of the fabric cells, where the cells are square or rectangular. Thus, the ports allow passage of any suitable filling material, such as a concrete mixture between cavities in the cells to form a mat at a loading or installation site.

In one embodiment, the depicted mat 100 may be partially assembled at a manufacturing site, where the first and second fabric layers 220, 222 are joined together to form the fabric cells 206. The fabric layers 220, 222 may be joined around the cable grids 212 at the manufacturing site, thereby providing support for the mat the cells. The plurality of fabric cells 206 may remain empty (i.e., not filled with a filling material) at the manufacturing site, thus providing improved mobility and ease of transport of the mat 100 during transport from the manufacturing site to the loading site (e.g., dockside or pier). In an embodiment, the mat 100 is transported to the loading site where the empty fabric cells 206 are filled with a filling material and cured, thereby forming the finished mat 100. By filling the mat 100 with a filling material at the loading site, shipping costs are reduced, due to the reduced load and increased amount of mats that may be transported, while mat mobility is improved. In embodiments, the filling material may be provided separately at the loading site. For example, empty mats may be shipped via a first truck and concrete mix may be provided via a second truck, where the concrete mix is added at the site when the mats are positioned to receive the filling material. In an embodiment, the loading site is a dock where a vessel receives the filled concrete mat 100 and transports the mat to the installation site, such as an underwater pipeline location. The vessel and/or loading site may include the lifting mechanism 106, such as a crane apparatus or winch, that attaches to the finished mat 100 to place the mat on the vessel after the mat is filled. Further, a lifting mechanism 106 on the vessel may also lift the mat 100 into the water once the vessel has reached the installation site.

Figure 3:
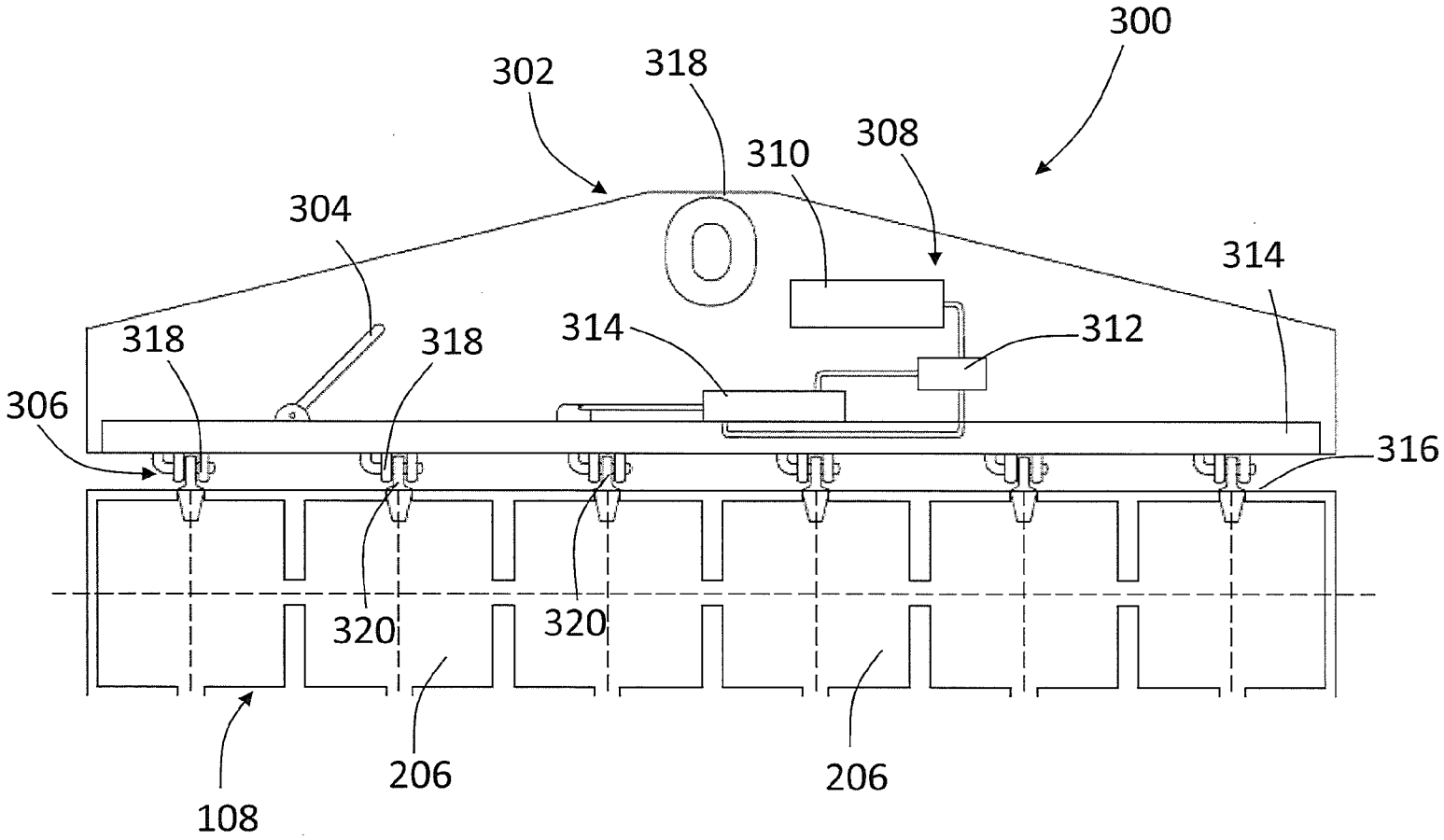
FIG. 3 is a front view of a portion of a mat and a frame according to an embodiment.

FIG. 3 is a detailed view of a portion of installation apparatus 300 used to install a mat, such as mat 108. The apparatus 300 includes a frame 302 with a coupling or connector mechanism 306 that releasably couples to an edge 316 of the mat 108. In an embodiment, the frame 302 couples to a lifting mechanism at a connection point 318, where the lifting mechanism lowers the installation apparatus 300 from a vessel to a sea floor installation location. The frame 302 includes a manual release lever 304 in addition to an automated release mechanism 308, where the lever 304 and automated release mechanism 308 are each configured to release the mat 108 from the frame 302. In an embodiment, the automated release mechanism 308 includes a hydraulic accumulator 310, an actuator 312 and a hydraulic ram 314. The hydraulic ram 314 is operationally and/or mechanically coupled to the connector mechanism 306 and is further configured to control release of the mat 108 from the apparatus 300. For example, the actuator 312 may include a receiver or sensor that receives a release signal to cause the actuator 312 to provide pressurized fluid from the hydraulic accumulator 310 to the hydraulic ram 314. The hydraulic ram 314 receives the pressurized fluid and provides mechanical force, such as linear or rotational force, to open receiving members 318 and release the members 320 of the connector mechanism 306, thus releasing the mat 108. In an embodiment, the receiving members 318 of the connector mechanism 306 extend from a bar 314 of the frame 302, while the members 320 extend from the cable grid integrated into the mat 108. In embodiments, any suitable releasable assembly may be used for the connector mechanism 306, such as steel spelter sockets, pin and eye assemblies, shackles, repair links, pelican hooks or other devices intended for the purpose of connecting ropes, cables or other load bearing tendons to each other or to objects. In one example, a release signal is an acoustic signal provided from a transmitter on the surface or subsea to release the mat 108. The manual release lever 304 may be used by a diver or robotic unmanned device (ROV) as an alternative to the automatic release mechanism 308, depending on application needs. Any suitable mechanism for providing the mechanical force and controlling the movement to release the mat may be utilized.

Figure 4:
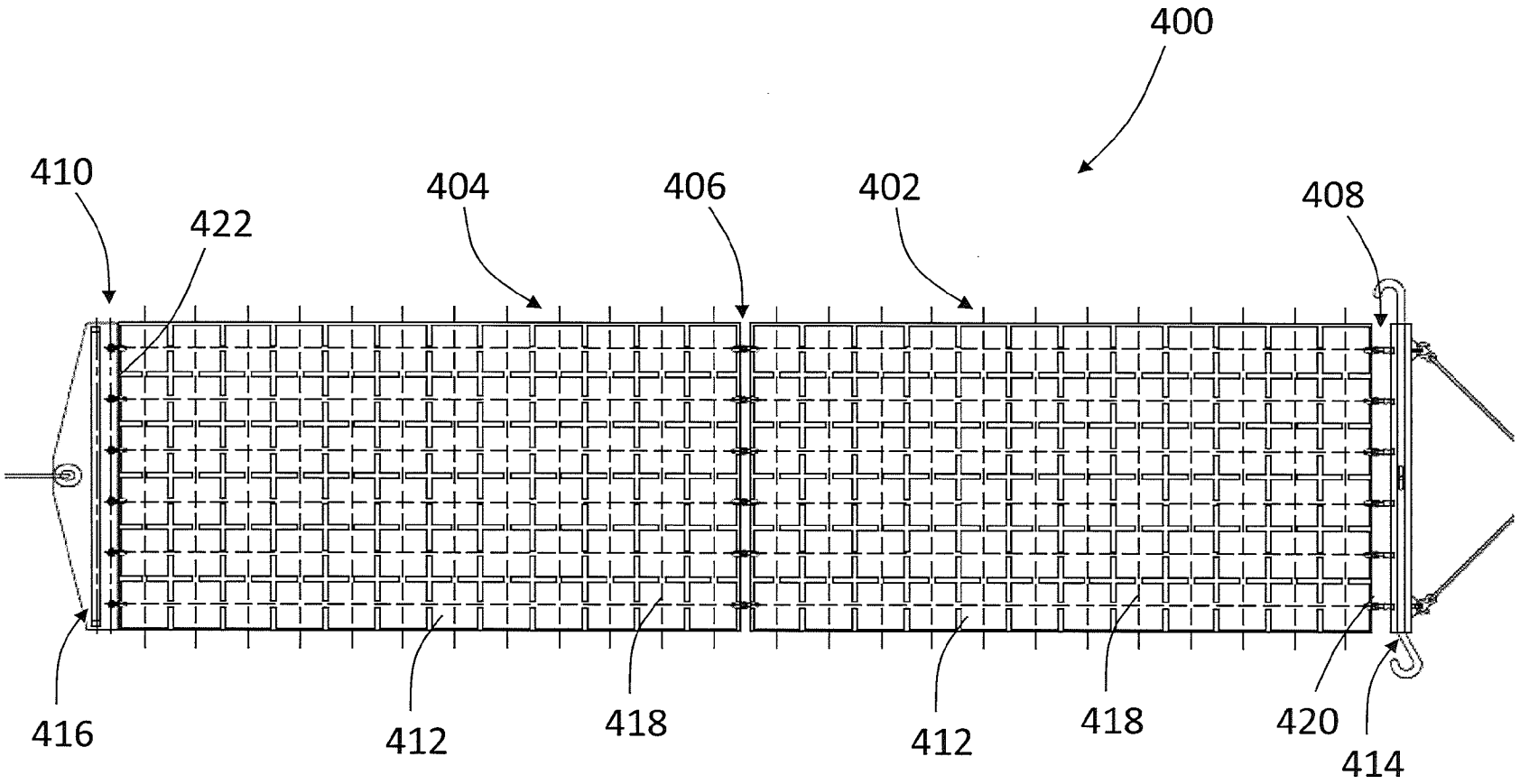
FIG. 4 is a front view of two mats coupled together and also coupled to a frame and a support assembly according to an embodiment.

FIG. 4 is a front view of a mat installation apparatus 400, where a first mat 402 and a second mat 404 are coupled together via a connector mechanism 406 for installation at a sea floor location. The first mat 402 is coupled via a connector mechanism 408 to a frame 414. The second mat 404 is coupled via a connector mechanism 410 to a support frame assembly 416. In an embodiment, the connector mechanisms 406, 408 and 410 may be substantially similar to those described above with reference to FIGS. 1-3. The connectors may be universal, allowing flexibility to connect mat segments to each other and/or to frames for installation. For example, the connector mechanisms may include spelter socket members extending from each of the frame 414 and first mat 402, as well as the first mat 402 and second mat 404. The connector mechanisms are coupled to or integrated with a cable grid 418 disposed within cells 412 of each mat. Accordingly, the connector mechanisms 406, 408 and 410 support lifting of the mats 402 and 404 when coupled to one side, such as side 420, of the mat assembly. As depicted, the support frame assembly 416 is attached to side 422 of mat 404 to provide additional control of the mat assembly during installation.

Figure 5:
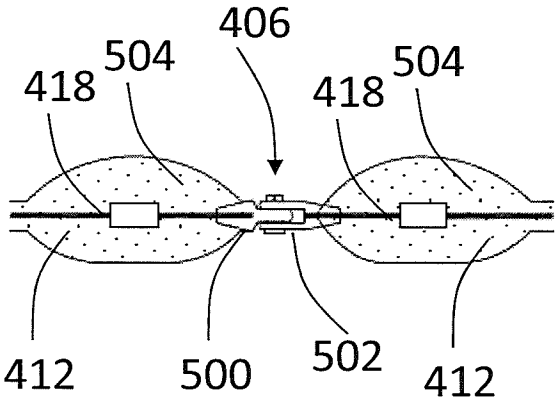
FIG. 5 is a detailed sectional side view of a portion of two mats coupled via a connector mechanism according to an embodiment.

FIG. 5 is a side section view of a portion of the mat assembly, where cells 412 are connected via the connector mechanism 406. In an aspect, the connector mechanism 406 is a steel spelter socket assembly, where a first member 500 and a second member 502 are coupled together via a bolt or pin. Embodiments of the connector mechanism 412 may include any suitable connector, such as a steel bracket or pin and eye assembly. As depicted, the cells 412 are filled with a filling material, such as concrete or cement. In an embodiment, substantially square fabric cells 412 are formed from a pair of fabric layers. As depicted in FIGS. 4 and 5, the fabric cells 412 have a first cell edge and a second cell edge being substantially parallel and aligned in a first direction. Further, the fabric cells 412 have a third cell edge and fourth cell edge that are substantially parallel and aligned in a second direction that is substantially perpendicular to the first direction. The fabric cells 412 configuration provides articulation of the cells and the mat during transport and installation. For example, a 20 foot by 20 foot mat may be lifted on first and second sides that are parallel and opposite one another, such as sides 420 and 422, to cause the mat to articulate into a J-shape or a U-shape when viewed from the side. Further, the mat may also be lifted by third and fourth sides that are parallel and perpendicular to the first and second sides (e.g., 420 and 422), to cause the mat to articulate into a substantially similar J-shape or a U-shape when viewed from the side. This flexibility in articulation may provide improved flexibility during installation over objects on the sea floor as well as improved mobility during transport.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

The invention claimed is:

1. A method of placing a mat, the method comprising:

providing a mat comprising a plurality of fabric cells formed from a first fabric layer and a second fabric layer, wherein ports in each of the fabric cells provide fluid communication between each of the fabric cells;

pumping the plurality of fabric cells with a filling material at a loading site;

coupling a connector mechanism on a frame to a first side of the filled mat, wherein the connector mechanism only releasably couples with an edge of the first side;

lifting the filled mat by a lifting mechanism coupled to the frame only on the first side, wherein the frame and connector mechanism support the filled mat when lifted by the first side; and lowering the filled mat into a body of water via the lifting mechanism.

2. The method of claim 1, wherein providing the mat comprises transporting the mat from a manufacturing site to the loading site prior to pumping the plurality of fabric cells.

3. The method of claim 1, wherein the loading site comprises a site proximate to or on a vessel that includes the lifting mechanism.

4. The method of claim 1, wherein providing the mat comprises providing a grid of cables disposed within and supporting the plurality of fabric cells, wherein the arrangement of the plurality of fabric cells enables substantially similar articulation in a first and second directions after the mat is filled, the first and second directions being substantially perpendicular to one another.

5. The method of claim 4, wherein coupling the connector mechanism on the frame to the first side of the filled mat comprises coupling the connector mechanism to connectors integrated with the grid of cables.

6. The method of claim 1, further comprising releasing the first side of the mat from the connector mechanism based on receiving an input.

7. The method of claim 6, wherein releasing comprises releasing the entire first side of the mat substantially simultaneously by releasing the connector mechanism.

8. The method of claim 6, wherein the input comprises an acoustic signal from a surface.

* * * * *